US008918925B2

(12) United States Patent
Zhou et al.

(10) Patent No.: US 8,918,925 B2
(45) Date of Patent: Dec. 30, 2014

(54) LIFTING ROD ASSEMBLY

(75) Inventors: Huasong Zhou, Xiamen (CN); Huasheng Peng, Xiamen (CN); Hua Yao, Xiamen (CN); Renzhong Li, Xiamen (CN)

(73) Assignees: Xiamen Solex High-Tech Industries Co., Ltd., Xiamen (CN); Huasong Zhou, Xiamen (CN)

( * ) Notice: Subject to any disclaimer, the term of this patent is extended or adjusted under 35 U.S.C. 154(b) by 162 days.

(21) Appl. No.: 13/642,163

(22) PCT Filed: Apr. 28, 2011

(86) PCT No.: PCT/CN2011/073422

§ 371 (c)(1),
(2), (4) Date: Oct. 19, 2012

(87) PCT Pub. No.: WO2011/134405

PCT Pub. Date: Nov. 3, 2011

(65) Prior Publication Data

US 2013/0026320 A1 Jan. 31, 2013

(30) Foreign Application Priority Data

Apr. 30, 2010 (CN) ..... 2010 1 0160932
Apr. 30, 2010 (CN) ..... 2010 2 0176994

(51) Int. Cl.
*A47K 3/022* (2006.01)

(52) U.S. Cl.
USPC ..... 4/601; 4/567; 4/568; 4/604; 4/615; 248/230.1; 248/295.11

(58) Field of Classification Search
USPC ..... 248/230.1, 295.11; 4/615, 605, 601, 4/570, 567, 604; 239/283
See application file for complete search history.

(56) References Cited

U.S. PATENT DOCUMENTS

| | | | | |
|---|---|---|---|---|
| 3,471,872 | A * | 10/1969 | Symmons | 4/570 |
| 5,749,552 | A * | 5/1998 | Fan | 248/205.8 |
| 5,833,192 | A | 11/1998 | Buhrman | |
| 7,043,776 | B1 * | 5/2006 | Wu | 4/601 |
| 7,197,776 | B2 | 4/2007 | Tsai | |
| 2009/0266913 | A1 | 10/2009 | Tsai | |

FOREIGN PATENT DOCUMENTS

| | | | |
|---|---|---|---|
| CN | 2841776 | Y | 11/2006 |
| CN | 200999361 | Y | 1/2008 |
| CN | 201056728 | Y | 5/2008 |
| CN | 201140148 | Y | 10/2008 |
| CN | 201248644 | Y | 6/2009 |
| CN | 201650955 | U | 11/2010 |
| CN | 102003442 | A | 4/2011 |

* cited by examiner

*Primary Examiner* — Amy J Sterling
(74) *Attorney, Agent, or Firm* — Rabin & Berdo, P.C.

(57) ABSTRACT

A lifting rod assembly is connected to the support arm and has a body unit, a lifting rod and a friction piece. The body unit has a sleeving hole penetrating from front to back and a connecting hole penetrating the sleeving hole from inside to outside, the sleeving hole is sleeved out of the support arm; the thread of the upper end part of the lifting rod is mounted in the connecting hole of the body; and the friction piece is mounted in the upper end part of the lifting rod and adaptive to the support arm, the compressing level between the friction piece and the support arm can be controlled though the screwing level between the lifting rod and the connecting hole of the body unit.

9 Claims, 6 Drawing Sheets

LIFTING ROD ASSEMBLY

FIELD OF THE INVENTION

The present invention relates to a lifting rod assembly, more particularly to a lifting rod assembly used in the shower equipment of the shower field.

BACKGROUND OF THE INVENTION

The traditional lifting rod assembly used in the shower field usually comprises an upper wall seat, a lower wall seat and a lifting rod, the upper and the lower wall seats are fixed on the wall, and the lifting rod fixed between the upper and the lower wall seat. Two wall seats are used in the traditional lifting rod device with enhanced construction difficulty and cost, and with increased material and manufacture cost. Aiming at the defect above, some solutions are present, such as ZL200820103272.4 and ZL200720118108.6 disclosed by the Chinese patent database, which all provide the technical proposal with only one wall seat, although it solves the defect above, there are still some defects: 1.the structure is complicated and the assembly is inconvenient; 2. it can not be directly used in the present American support arm, so it has low applicability.

SUMMARY OF THE INVENTION

The object of the present invention is to offer a lifting rod assembly which overcomes the defect of inconvenient assembling of the lifting rod assembly at the prior.

The technical proposal solving the technical matter in the present invention is:

Lifting rod assembly, which is connected to the support arm and comprises:

A body unit, which is provided with a sleeving hole penetrating from front to back and a connecting hole penetrating the sleeving hole from inside to outside, the sleeving hole is sleeved out of the support arm;

A lifting rod, of which the thread of the upper end part is mounted in the connecting hole of the body unit; and A friction piece, which is mounted in the upper end part of the lifting rod and adaptive to the support arm, the compressing level between the friction piece and the support arm can be controlled through the screwing level between the lifting rod and the connecting hole of the body unit.

In a preferred embodiment, the body unit comprises:

A body, which is provided with a through hole and a first penetrating hole penetrating the through hole from the inside to the outside, and the through hole is adaptively sleeved out of the support arm with gap, a stuck slot is arranged on the inner revolution surface of the through hole; and A pipe sleeve, which is provide with a buckle and a second penetrating hole penetrating the pipe sleeve from the inside to the outside, and the pipe sleeve is located between the body and the support arm, the buckle is adaptively clamped to the stuck slot of the body, the first penetrating hole and the second penetrating hole are aligned with each other and form the connecting hole.

In a preferred embodiment, a fillet along the axis is convexly arranged in the through hole of the body; a cutting slot penetrating along the axis and from the inside to the outside is opened on the pipe sleeve; the cutting slot is adaptive to the fillet.

In a preferred embodiment, the body comprises a locating sleeve and a fixed head fixedly connected under the locating sleeve, the inner hole of the locating hole is the said through hole, the first penetrating hole is opened on the fixed head and penetrates the through hole from the inside to the outside, the first penetrating hole is divided to the upper small hole and the lower big hole, an internal thread is arranged on the inner revolution surface of the lower big hole.

In a preferred embodiment,

A step is convexly arranged on the inner revolution surface of the upper end part of the lifting rod;

The friction piece comprises a base and a friction head, the base is arranged on the step in a supporting manner, and the friction head can pass through the upper small hole of the first penetrating hole.

In a preferred embodiment, a semi-cylindrical slot adaptive to the support arm is concavely arranged on the top surface of the friction head.

In a preferred embodiment, the friction head extends out of the upper end part of the lifting rod.

In a preferred embodiment, which also comprises: a sucker mechanism fixedly connected to the lower end part of the lifting rod.

In a preferred embodiment, which also comprises: a sliding seat connected to the lifting rod.

In a preferred embodiment, the cutting slot is communicated with the second penetrating hole.

Compared with the technical proposal at the prior, the benefits of the present invention are:

1 The compressing level between the friction piece and the support arm can be controlled though the screwing level between the lifting rod and the connecting hole of the body unit, and the locking between the lifting rod assembly and the support arm is controlled, the structure of the present invention is simple with convenient assembly, and the present invention can be directly used in the present American support arm with good applicability.

2 A cutting slot penetrating from the inside to the outside along the axis is opened on the pipe sleeve, so that the pipe sleeve is provided with some elasticity, and the size of the inner hole can be reasonably adjusted to sleeve the pipe sleeve to the support arm;

3 A fillet along the axis is convexly arranged in the through hole of the body, the cutting slot is adaptive to the fillet to avoid the relative rotation between the pipe sleeve and the body, and to enhance the strength of the body unit, and to guide assembly simple.

4 The buckle is adaptively clamped to the stuck slot of the body with tight locking and easy assembly, and it is convenient for the users to know whether the assembly is in place;

5 A semi-cylindrical slot adaptive to the support arm is concavely arranged on the top surface of the friction head with large contact area with reliable locking.

REFERENCE SIGN

Figure 1:
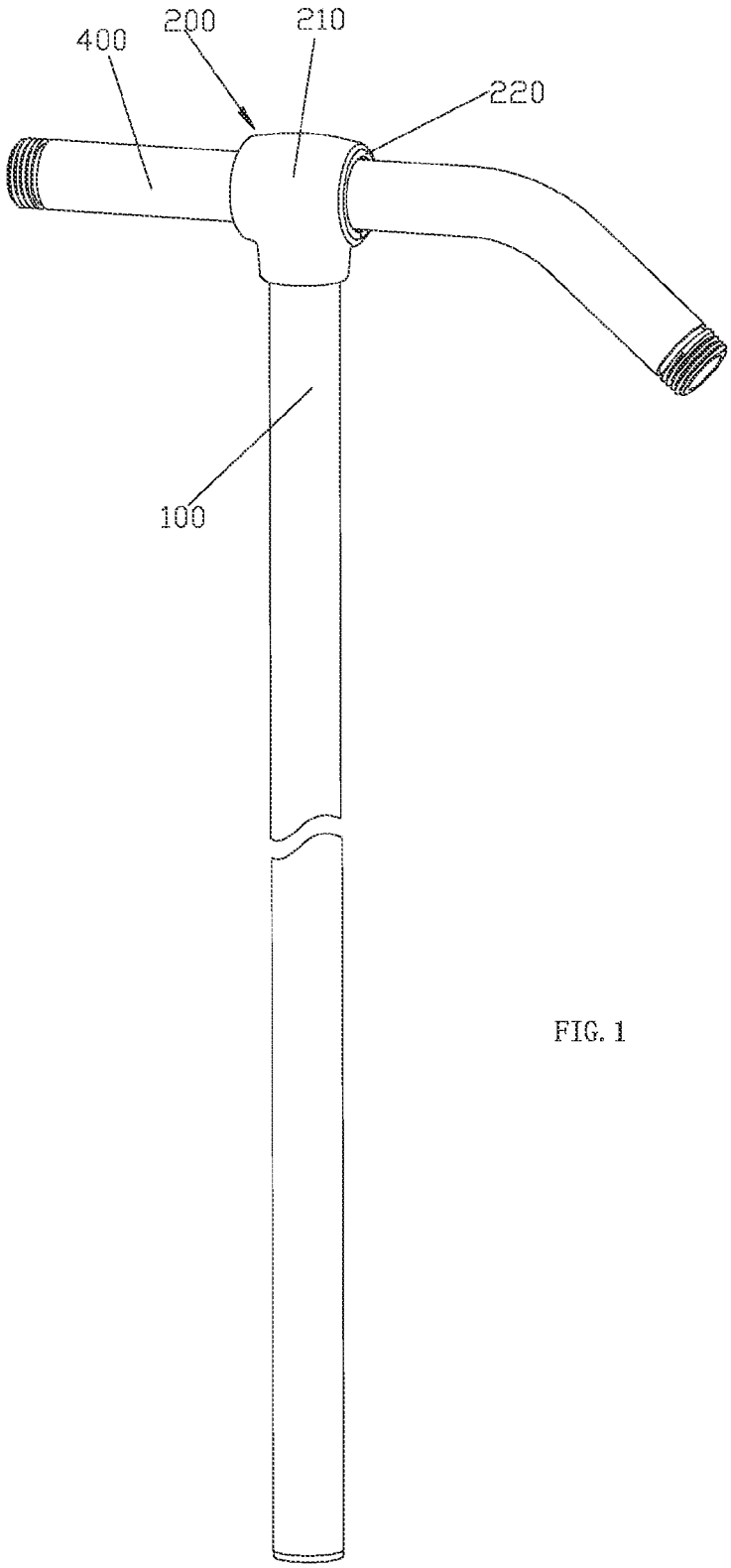
FIG. 1 shows the solid abridged general view of the lifting rod assembly.

Lifting rod 100, body unit 200, friction piece 300, support arm 400, step 110, thread 1001, body 210, pipe sleeve 220, locating sleeve 211, fixed head 212, through hole 213, stuck slot 216, fillet 217, upper small hole 214, lower big hole 215, buckle 221, second penetrating hole 222, cutting slot 223, base 310, friction head 320, convex shaft 330, semi-cylinder slot 321.

DESCRIPTION OF THE PREFERRED EMBODIMENTS

With the following description of the drawings and specific embodiments, the invention shall be further described in details.

Figure 2:
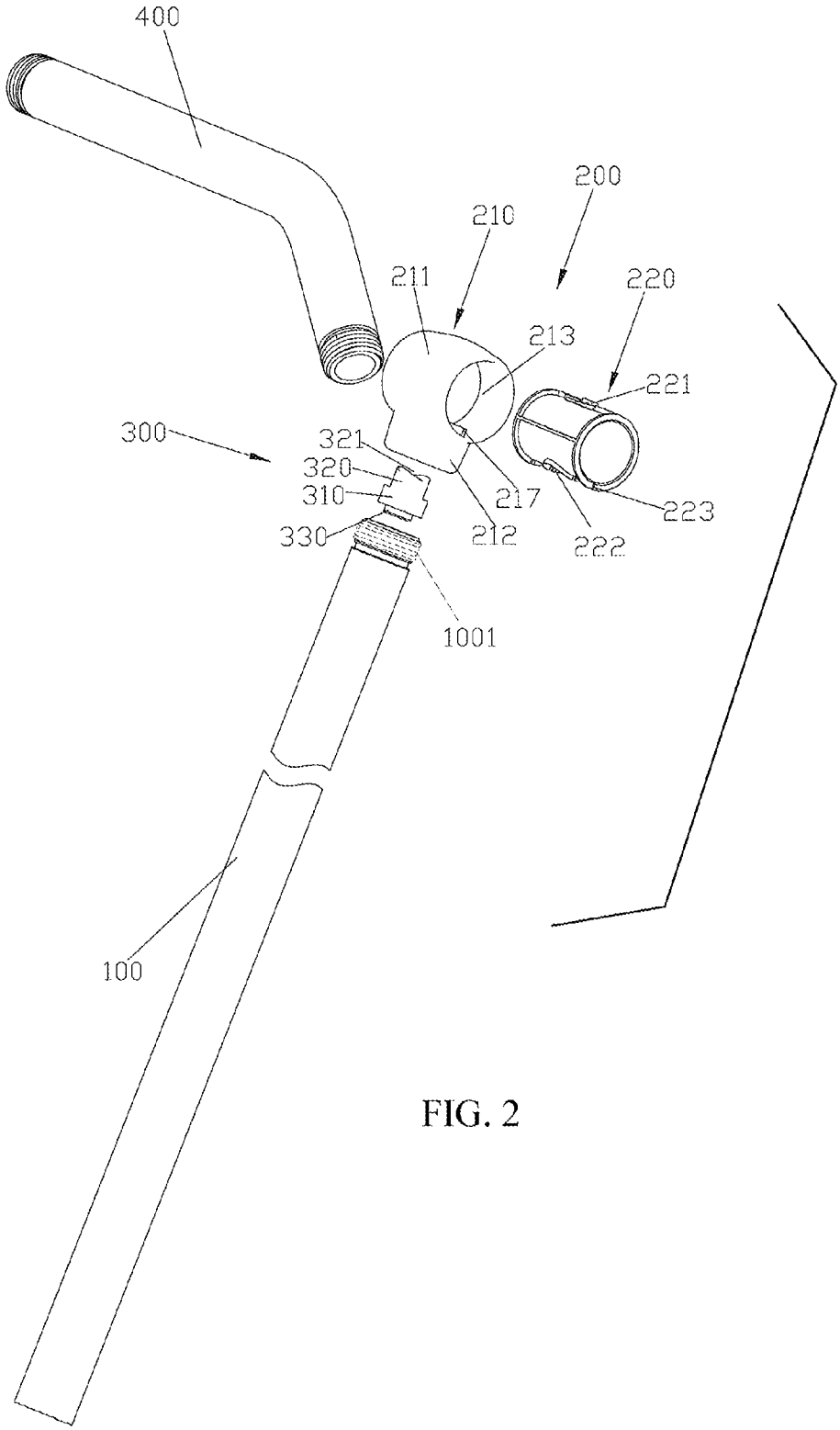
FIG. 2 shows the solid exploded view of the lifting rod assembly.
Figure 3:
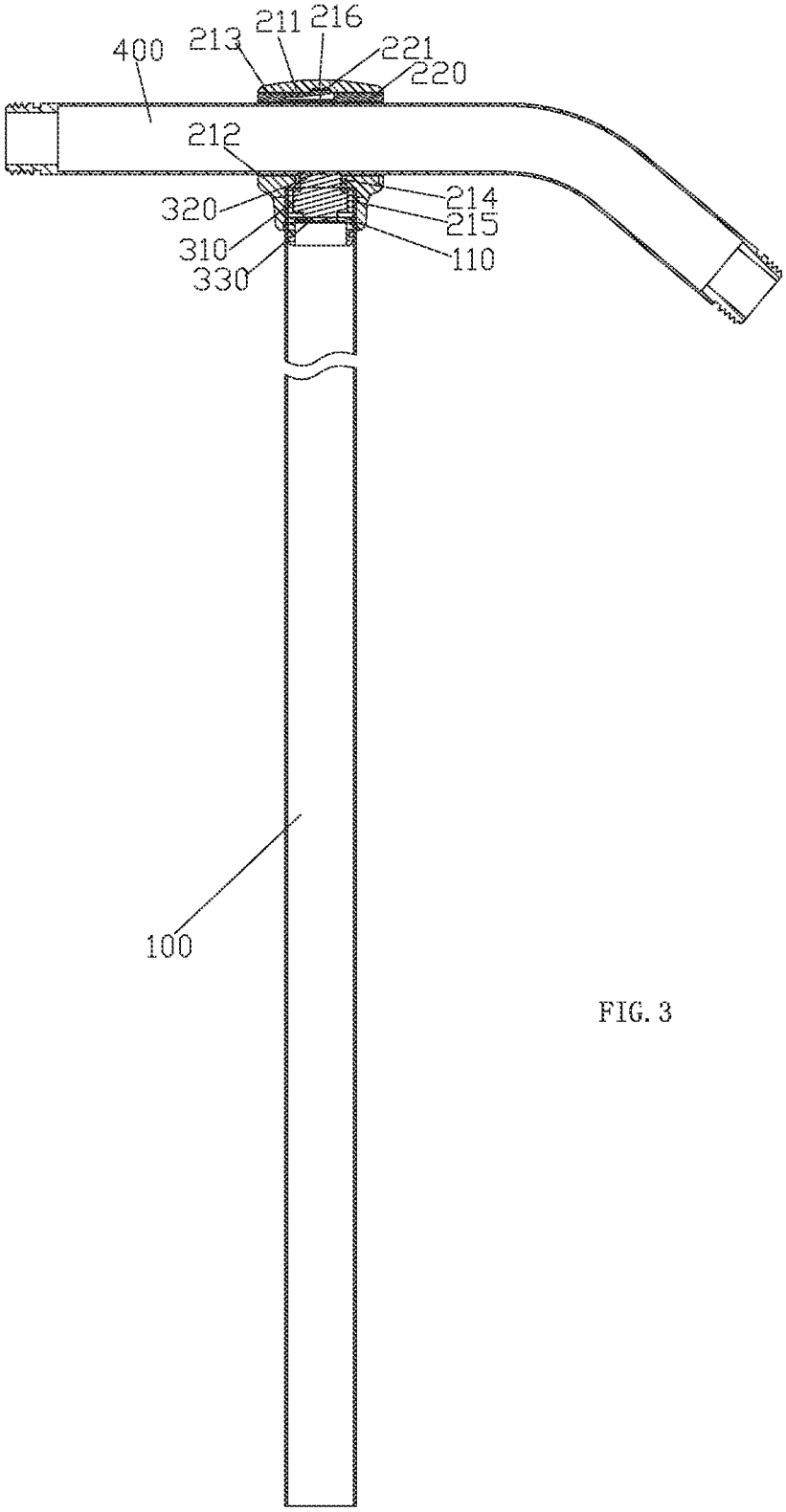
FIG. 3 shows the middle sectional view of the lifting rod assembly.
Figure 4:
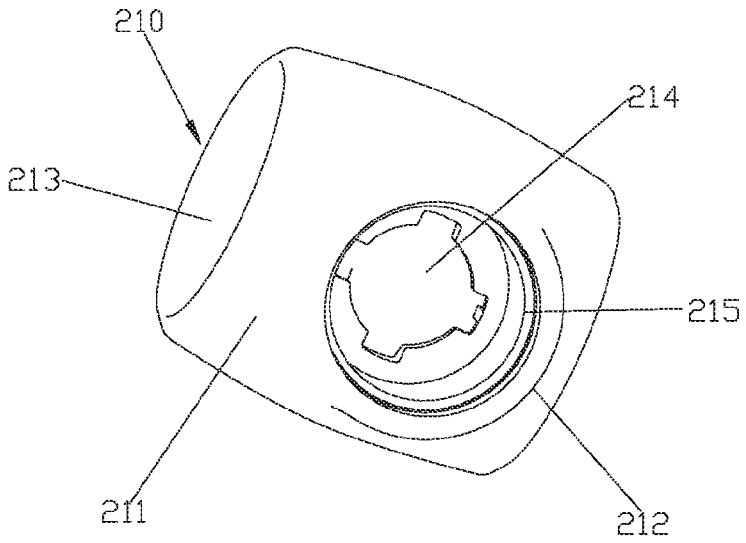
FIG. 4 shows the first solid abridged general view of the body.
Figure 5:
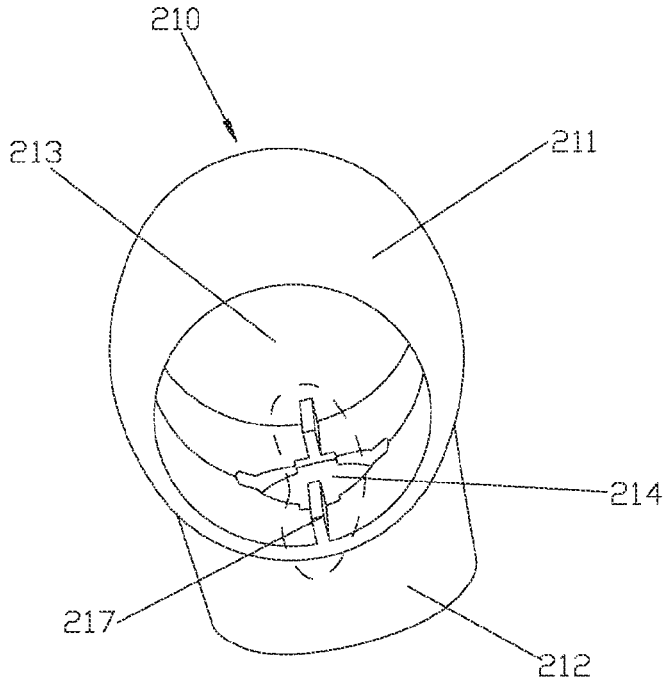
FIG. 5 shows the second solid abridged general view of the body.
Figure 6:
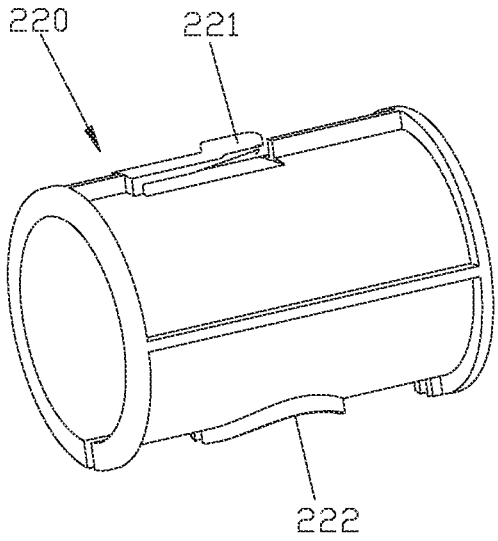
FIG. 6 shows the first solid abridged general view of the pipe sleeve.
Figure 7:
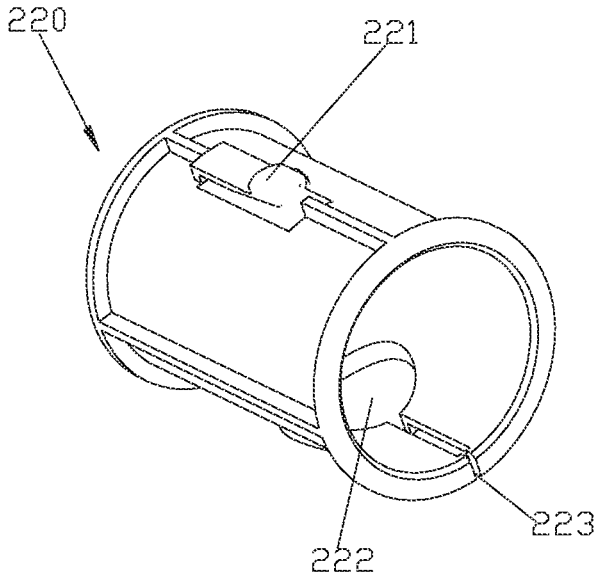
FIG. 7 shows the second solid abridged general view of the pipe sleeve.
Figure 8:
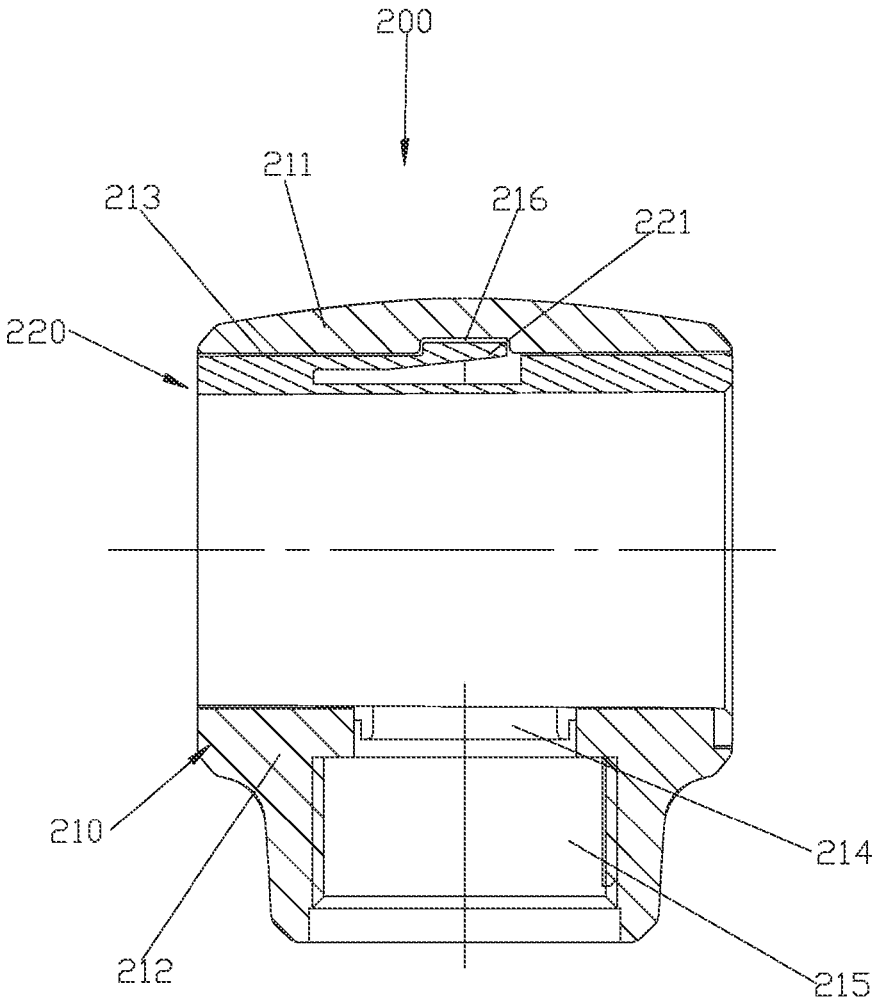
FIG. 8 shows the middle sectional view of the body unit.

According to FIG. 1 to FIG. 3, the lifting rod assembly comprises a lifting rod 100, a body unit 200, a friction piece 300, a sucker body and a sliding seat. The lifting rod assembly is connected to the American support arm 400, the sliding seat is connected to the lifting rod 100 in a upward and downward sliding manner to splice the handheld shower.

An external thread 1001 is arranged on the outer revolution surface of the upper end of the lifting rod 100, a step 110 is convexly arranged on the inner revolution surface of the upper end, a gap is present between the step 110 and the upper end of the lifting rod 100.

According to FIG. 1 to FIG. 8, the body unit comprises a body 210 and a pipe sleeve 220.

The body 210 comprises a locating sleeve 211 and a fixed head 212 fixedly connected under the locating sleeve 211. The inner hole of the locating sleeve 211 is a through hole 213, a stuck slot 216 is concavely arranged on the inner revolution surface of the through hole 213, a fillet 217 along the axis is concavely arranged in the through hole 213, the through hole 213 is adaptively sleeved out of the support arm 400 with gap (namely the inner diameter of the through hole 213 is larger than the outer diameter of the support arm 400). A first penetrating hole is opened on the fixed head to penetrate the through hole 213 from the inside to the outside, the first penetrating hole is divided to the upper small hole 214 and the lower big hole 215, an internal thread is arranged on the inner revolution surface of the lower big hole 215, which is adaptive to the external thread.

The pipe sleeve 220 is provided with a buckle 221, a second penetrating hole 222 penetrating the pipe sleeve 220 from the inside to the outside and a cutting slot 223 along the axis to penetrate and adaptive to the fillet 217. The pipe sleeve 220 is located and arranged between the body 210 and the support arm 400, the buckle 221 is adaptive to and clamped to the stuck slot 216 of the body 210, and the first penetrating hole is aligned at the second penetrating hole 222. The cutting slot 223 is communicated with the second penetrating hole 222 to provide the pipe sleeve 220 with certain elasticity.

The friction piece 300 comprises a base 310 and a friction head 320, a locating convex shaft 330 is convexly arranged under the base 310, a semi-cylindrical slot 321 adaptive to the support arm is concavely arranged on the top surface of the friction head 320. The locating convex shaft 330 is adaptively inserted into the inner revolution surface of the step 110 of the lifting rod 100, the base 310 is adaptively arranged on the step 110 in a supporting manner, the friction head 320 extends out of the upper end face of the lifting rod.

For better understanding the present invention, the assembly process is introduced in details: the body 210 is sleeved out of the support arm 400; the pipe sleeve 220 is sleeved out of the support arm 400, and the cutting slot 223 is aligned at the fillet 217, and the pipe sleeve 220 is pushed into the gap between the body 210 and the pipe sleeve 220 until the buckle 221 is clamped to the stuck slot 216; the friction piece 300 is arranged on the step 110 of the lifting rod 100 in a supporting manner; the upper end part of the lifting rod 100 is screwed into the lower big hole 215 of the first penetrating hole, and the friction piece 300 continuously rises with the screwing of the lifting rod 100, and the friction force between the friction head 300 and the support arm 400 is enhanced continuously until it is fastened; and the sucker mechanism fixedly absorbs the wall.

The invention has been described with reference to the preferred embodiments mentioned above; therefore it cannot limit the reference implementation of the invention. It is obvious to a person skilled in the art that structural modification and changes can be carried out without leaving the scope of the claims hereinafter and the description above.

INDUSTRIAL APPLICABILITY

The lifting rod assembly in the present invention, the compressing level between the friction piece and the support arm can be controlled through the screwing level between the lifting rod and the connecting hole of the body unit, and the locking between the lifting rod assembly and the support arm is controlled, the structure of the present invention is simple with convenient assembly, and the present invention can be directly used in the present American support arm with good applicability.

What is claimed is:

1. Lifting rod assembly, which is connected to a support arm, comprising:

a body unit, which is provided with a sleeving hole penetrating from front to back and a connecting hole penetrating the sleeving hole from inside to outside, the sleeving hole is sleeved out of the support arm;

a lifting rod, of which the thread of the upper end part is mounted in the connecting hole of the body unit; and a friction piece, which is mounted in the upper end part of the lifting rod and adaptive to the support arm, the compressing level between the friction piece and the support arm can be controlled through the screwing level between the lifting rod and the connecting hole of the body unit, wherein the body unit comprises:

a body, which is provided with a through hole and a first penetrating hole penetrating the through hole from the inside to the outside, and the through hole is adaptively sleeved out of the support arm with gap, a stuck slot is arranged on the inner revolution surface of the through hole; and a pipe sleeve, which is provide with a buckle and a second penetrating hole penetrating the pipe sleeve from the inside to the outside, and the pipe sleeve is located between the body and the support arm, the buckle is adaptively clamped to the stuck slot of the body, the first penetrating hole and the second penetrating hole are aligned with each other and form the connecting hole.

2. Lifting rod assembly according to claim 1, wherein, a fillet along the axis is convexly arranged in the through hole of the body; a cutting slot penetrating along the axis and from the inside to the outside is opened on the pipe sleeve; the cutting slot is adaptive to the fillet.

3. Lifting rod assembly according to claim 2, wherein, the body comprises a locating sleeve and a fixed head fixedly connected under the locating sleeve, the inner hole of the locating hole is the said through hole, the first penetrating hole is opened on the fixed head and penetrates the through hole from the inside to the outside, the first penetrating hole is divided to the upper small hole and the lower big hole, an internal thread is arranged on the inner revolution surface of the lower big hole.

4. Lifting rod assembly according to claim 3, wherein, a step is convexly arranged on the inner revolution surface of the upper end part of the lifting rod, the friction piece comprises a base and a friction head, the base is arranged on the step in a supporting manner, and the friction head can pass through the upper small hole of the first penetrating hole.

5. Lifting rod assembly according to claim 4, wherein, a semi-cylindrical slot adaptive to the support arm is concavely arranged on the top surface of the friction head.

6. Lifting rod assembly according to claim 4, wherein, the friction head extends out of the upper end part of the lifting rod.

7. Lifting rod assembly according to claim 3, wherein, which also comprises: a sucker mechanism fixedly connected to the lower end part of the lifting rod.

8. Lifting rod assembly according to claim 3, wherein, which also comprises: a sliding seat connected to the lifting rod.

9. Lifting rod assembly according to claim 3, wherein, the cutting slot is communicated with the second penetrating hole.

* * * * *